US005533379A

United States Patent [19]

Binder et al.

[11] Patent Number: 5,533,379

[45] Date of Patent: Jul. 9, 1996

[54] METHOD OF FORMING A HEAD ON A FASTENER

[75] Inventors: John Binder, Morton Grove; Henry W. Schniedermeier, Niles; Lawrence S. Shelton, Morton Grove; Henry A. Sygnator, Arlington Heights; William L. Gabriel, Barrington, all of Ill.

[73] Assignee: Illinois Tool Works Inc., Glenview, Ill.

[21] Appl. No.: 486,676

[22] Filed: Jun. 7, 1995

Related U.S. Application Data

[62] Division of Ser. No. 136,647, Oct. 14, 1993, Pat. No. 5,476,351.

[51] Int. Cl.[6] ..... B21G 3/12

[52] U.S. Cl. ..... 72/316; 470/27; 470/137; 72/377

[58] Field of Search ..... 72/316, 318, 377; 470/27, 34, 38, 40, 121, 137, 141, 159, 150, 195, 192, 196

[56] References Cited

U.S. PATENT DOCUMENTS

| | | | |
|---|---|---|---|
| 1,207,948 | 12/1916 | Long | 72/318 |
| 1,619,944 | 3/1927 | Leonard | 411/453 |
| 1,699,421 | 1/1929 | Bean | 411/481 |
| 1,944,150 | 1/1934 | Brugge | 411/439 |
| 1,955,924 | 4/1934 | MacLean | 411/399 |
| 1,968,516 | 7/1934 | Dieter | 411/399 |
| 2,049,259 | 7/1936 | Greenwell | 411/399 |
| 2,074,773 | 3/1937 | Camp | 470/121 |
| 2,718,647 | 9/1955 | Raible | 470/40 |
| 2,982,166 | 5/1961 | Hobbs | 411/399 |
| 3,089,159 | 5/1963 | Carlson | 72/377 |

FOREIGN PATENT DOCUMENTS

| | | | |
|---|---|---|---|
| 396605 | 4/1909 | France | 411/439 |
| 624810 | 7/1927 | France | 72/318 |

*Primary Examiner*—Daniel C. Crane
*Attorney, Agent, or Firm*—Schwartz & Weinrieb

[57] ABSTRACT

A method and apparatus for forming a head, having a controlled predetermined shape on an end of an elongate member, such as a wire, which is formed into a fastener, where an end portion of the wire is secured in a predetermined position and axially compressed so as to expand a predetermined amount of wire material radially outwardly and thereby form the head on the wire, and where material flow is directed during axial compression so as to provide the controlled predetermined shape of the head.

16 Claims, 1 Drawing Sheet

Fig. 1
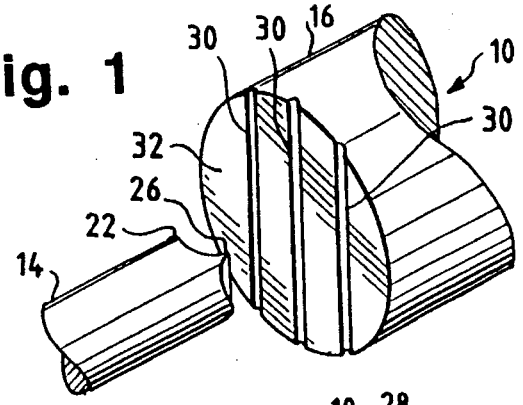
Fig. 3
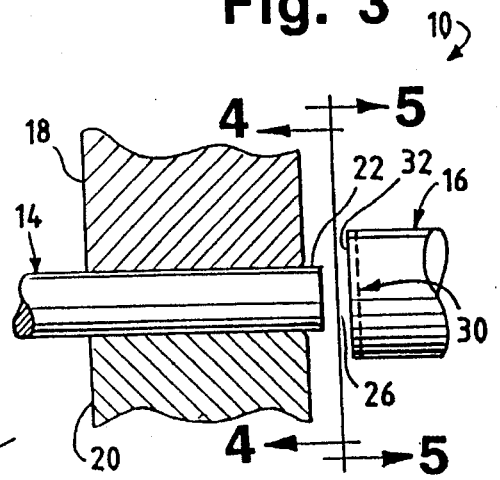
Fig. 2
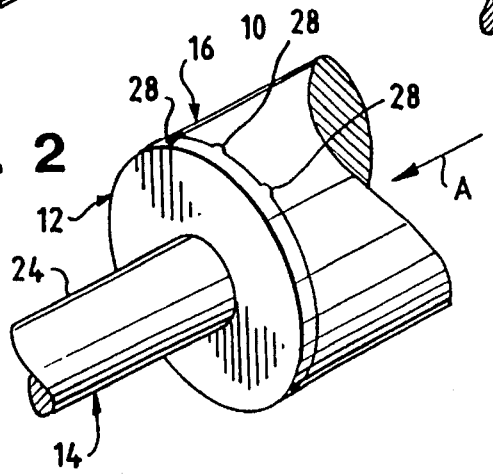
Fig. 5
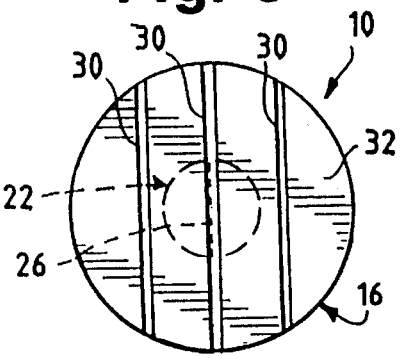
Fig. 4
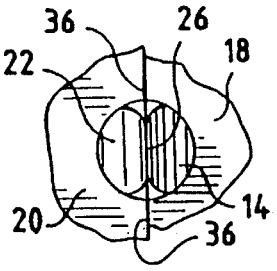
Fig. 7
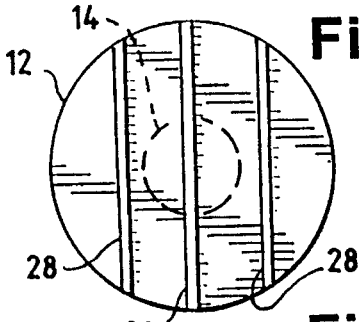
Fig. 6 PRIOR ART
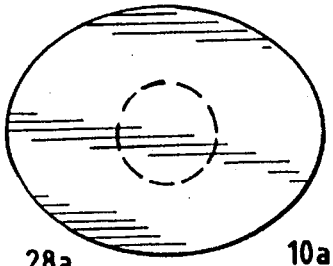
Fig. 8
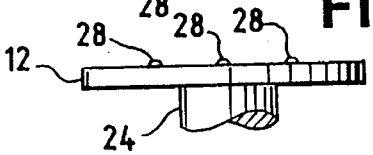
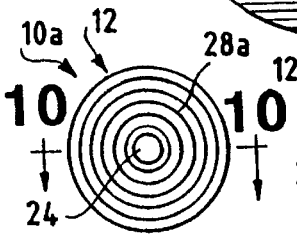
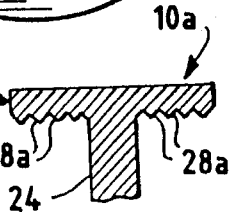
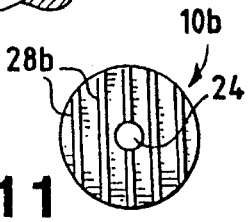
Fig. 9 Fig. 10 Fig. 11

METHOD OF FORMING A HEAD ON A FASTENER

This application is a division, of application Ser. No. 08/136,647, filed Oct. 14, 1993, now U.S. Pat. No. 5,476, 351, issued Dec. 19, 1995.

BACKGROUND OF THE INVENTION

1. Field of the Invention

This invention relates generally to a method and apparatus for forming a head on a fastener, and more particularly to a method and apparatus for axially compressing an end portion of a wire so as to outwardly expand a predetermined amount of wire material and whereby form a head on the wire wherein the shape of the head is controlled by directing the flow of the wire material during the axial compression thereof.

2. Description of the Related Art

Typically, to form a fastener such as a nail, an end portion of a wire is axially compressed with a punch or the like with sufficient force so as to expand the end portion of the wire radially outwardly and thereby form a head thereon. The opposite end of the wire is then formed into a point so as to provide the finished nail.

During axial compression of the wire, the wire material tends to randomly expand outwardly without control. This random expansion typically results in a nail head that is slightly out of round and/or off-center with respect to the central axis of the wire shank, as illustrated in FIG. 6. Such a nail can be a problem when utilized in a power nailer causing tumbling or jamming of the nails therein.

It therefore would be desirable to provide a method and apparatus for axially compressing an end portion of a wire to so as to expand a predetermined amount of wire material radially outwardly in a controlled manner and thereby form a head on the wire wherein the shape of the head is consistent from part to part and is consistently centered with respect to a central axis of the wire.

SUMMARY OF THE INVENTION

The invention provides a method and apparatus for forming a head on an elongate member, such as a wire, which is formed into a fastener wherein the head is formed with a predetermined shape which is consistent from part to part and is consistently centered with respect to a central axis of the wire. An end portion of the wire is secured in a predetermined position and is axially compressed so as to expand a predetermined amount of wire material radially outwardly. In order to control the expansion of the wire, the flow of wire material is directed during the axial compression so as to provide the desired configuration.

Preferably, the axial compression is provided by a punch which strikes the end portion of the wire with a predetermined force. To direct the flow of wire material during punching, the contact surface of the punch includes one or more flow control channels formed therein. Alternatively, dies utilized to hold the wire during punching can include flow control channels to similarly direct the flow of material during punching.

BRIEF DESCRIPTION OF THE DRAWINGS

Various objects, features, and attendant advantages of the present invention will be more fully appreciated from the following detailed description, when considered in connection with the accompanying drawings, in which like reference characters designate like or corresponding parts throughout the several views, and wherein:

FIG. 1 is a perspective view, in partial section, of a head forming punch of the invention and an end portion of a wire before punching;

FIG. 2 is a perspective view, in partial section, of the head forming punch of the invention after a punching operation, illustrating the head formed on the wire;

FIG. 3 is an enlarged side elevational view of an end of a wire captured within a holding die, illustrated in partial section, prior to punching with the punch of the invention;

FIG. 4 is a top plan view of the end portion of the wire and die taken along line 4—4 of FIG. 3, illustrating a ridge of material typically included on the end of the wire before punching;

FIG. 5 is a top plan view of the head forming punch taken along line 5—5 of FIG. 3, illustrating the flow control channels thereof with the end portion of the wire in dotted outline illustrating the position of the wire with respect to the punch before punching;

FIG. 6 is a top plan view of a prior art nail having a head formed thereon without control of the flow of wire material;

FIG. 7 is a top plan view of a nail having a head formed by the method and apparatus of the invention, illustrating the substantially circular and centered head;

FIG. 8 is a side elevational view, in partial section, of the nail of FIG. 7;

FIG. 9 is a bottom plan view of another embodiment of a nail head of the present invention with circular ribs on the underside of the head;

FIG. 10 is a cross-sectional view of the nail head taken along line 10—10 of FIG. 9; and FIG. 11 is a bottom plan view of another embodiment of a nail head of the invention having flow control ribs on the underside of the nail head.

DESCRIPTION OF THE PREFERRED EMBODIMENTS

Referring to FIG. 2, the apparatus of the invention is generally illustrated with the reference numeral 10. The apparatus 10 preferably forms a head 12 on a wire 14 with a head forming punch 16 and is typically utilized in manufacturing fasteners, such as nails or the like.

Briefly, as FIGS. 2 and 3 illustrate, to form a nail, the wire 14 is provided from stock and is typically captured between a pair of holding dies 18 and 20 with an end portion 22 of the wire 14 protruding therefrom. The punch 16 is positioned adjacent to the end portion 22 so as to contact and axially compress the end portion 22 and thereby form the head 12 by forcing radially, outward expansion of the material of the wire 14.

To provide a shank 24 on the nail, the wire 14 is cut with a cutting tool (not illustrated) which is positioned on the side of the dies 18 and 20 opposite the punch 16. The cutting tool cuts and forms a pointed end (not illustrated) on the end of the now cut wire segment opposite the head 12 to complete the nail forming operation.

When formed in this way, a stub or ridge 26 of wire material is provided on the end portion 22 of the wire 14, as illustrated in FIG. 3, and extends substantially across the entire width or diameter of the wire 14 and forms an edge thereon. The size and shape of the ridge 26 depends on the type of cutting tool utilized and may be eliminated so long as the apparatus 10 functions as described herein.

As FIG. 7 illustrates, the head 12 typically formed by the method and apparatus of the invention is substantially circular in shape with a predetermined thickness and is centered with respect to a central axis of the wire 14. It is to be noted that the particular shape and dimensions of the head 12 can vary.

The head 12 also preferably includes a plurality of ribs 28 which are formed by the punch 16 as described in detail below. As FIGS. 7 and 8 illustrate, the ribs 28 are preferably are elongated, have a substantially semi-circular outer surface and extend across the entire diameter of the head 12. Preferably, the ribs 28 have a height which can vary between 0.001–0.015 inches (0.0254–0.381 mm) and are spaced approximately 0.065 inches (1.651 mm) apart. It is to be noted, however, that the particular geometry and spacing of the ribs 28 can vary.

The wire 14 is preferably made of a steel or other metal, is substantially circular in cross-section and can be plated for corrosion resistance, preferably with zinc. The particular material shape, size and coating of the wire 14, however, can vary.

As FIG. 1 illustrates, to control and direct the outward flow of wire material during the axial compression the punch 16 includes a plurality of flow control channels 30. The channels 30 are preferably semi-circular in cross-sectional configuration and extend into the face 32 of the punch 16 a predetermined distance, which can vary.

Although the desired flow control can be obtained with only one flow control channel 30, three flow control channels 30 are preferably utilized, are positioned substantially parallel to each other and extend across the entire width of the face 32. While three channels 30 are illustrated, the number, size and shape of the channels 30 can vary.

As FIG. 2 illustrates, the punch 16 axially contacts and compresses the wire 14 in the direction of arrow "A". The size of the head 12 may vary and depends upon a number of factors such as the extent to which the end portion 22 protrudes from the holding dies 18 and 20, the velocity and force of the punch 16, and the material of the wire 14, among other factors.

As FIG. 5 illustrates, the channels 30 of the punch 16 are preferably positioned, during the compression operation parallel with respect to the end portion 22 and the ridge 26 which are illustrated in dotted outline. The channels 30 can also be positioned at an angle with respect to the ridge 26 which can vary between 0°–90° so long as the desired results are obtained as described herein.

In operation, as FIG. 3 illustrates, the punch 16 axially contacts the end portion 22 of the wire 14 with a predetermined force. The punch 16 axially compresses the end portion 22 and forces radially, outward expansion of the end portion 22 of the wire 14 to form the head 12 as illustrated in FIG. 2.

During formation of the head 12, the material of the wire 14 is directed along the flow control channels 30 of the punch 16 resulting in a predetermined consistent shape with the head 12 being substantially centered with respect to the longitudinal axis of the wire 14. The head 12 and the shank 24 are thereafter cut from the remainder of the wire 14 to form the fastener.

As FIG. 4 illustrates, the dimensions of the wire 14 and the holding dies 18 and 20 are preferably are selected to provide a tight fit, with the dies 18 and 20 contacting along an interface 36. The holding dies 18 and 20 can include some type of gripper teeth (not illustrated) which can provide slight marks on the nails. The gripper marks, however, do not materially affect the forming or performance of the nail.

Preferably, the punch 16 is moved into engagement with the end portion 22 which is stationary. The punch 16, however, may be stationary and the end portion 22 can be moved into engagement with the punch 16 if desired.

FIGS. 9 and 10 illustrate another embodiment of a nail **10*a* of the present invention where similar elements are identified by the same reference numerals. In this embodiment, circular concentric ribs 28*a* are provided by the dies 18 and 20 on the bottom of the head 12. These circular ribs 28*a* perform the same function as the elongated ribs 28**.

FIG. 10 illustrates yet another embodiment of a nail **10*b* of the present invention where similar elements again are identified by the same reference numerals. In this embodiment, straight ribs 28*b* are provided on the bottom of the head 12 similar to ribs 28. The ribs 28*b* are provided by the dies 18 and 20** which include corresponding flow control channels (not illustrated.)

In either event, the number, shape and dimensions of the ribs **28*a* or 28*b*** can vary as desired to accommodate different head and shank diameters.

Modifications and variations of the present invention are possible in light of the above teachings. It therefore is to be understood that within the scope of the appended claims the invention may be practiced otherwise than as specifically described.

What is claimed and desired to be secured by Letters Patent is:

1. A method of forming a head on an elongate member, comprising the steps of:

positioning an end portion of an elongate member at a predetermined location; and exerting an axially compressive force against said end portion of said elongate member so as to radially outwardly expand a predetermined amount of material of said end portion of said elongate member and thereby form a head thereon which includes a plurality of ribs, all disposed parallel with respect to each other and with respect to a single diameter of said head and extending across said head, for controlling the flow of said material comprising said end portion of said elongate member in a predetermined direction parallel to said single diameter, and for accommodating said material comprising said end portion of said elongate member as said material comprising said end portion of said elongate member is expanded radially outwardly with respect to said elongate member of said fastener during said axial compression of said end portion of said elongate member and said formation of said head upon said elongate member such that said head has a predetermined configuration and wherein said head is substantially centered with respect to a longitudinal axis of said elongate member.

2. The method as defined in claim 1 wherein said step of exerting said axially compressive force against said end portion of said elongate member includes striking said end portion of said elongate member with a punch.

3. The method as defined in claim 2, wherein:

said step of controlling the direction of flow of said material comprising said end portion of said elongate member, and for accommodating said material comprising said end portion of said elongate member, is provided by a plurality of channels defined within said punch and within which said plurality of ribs are formed from said material comprising said end portion of said elongate member as said material comprising said end portion of said elongate member is expanded radially outwardly with respect to said elongate member of said fastener during said axial compression of said end portion of said elongate member and said formation of said head upon said elongate member.

4. The method as defined in claim 1, wherein:

said step of positioning said end portion of said elongate member is provided by dies which hold said elongate member when said elongate member is axially compressed.

5. The method as set forth in claim 1, wherein:

said plurality of ribs are formed upon said head such that one of said ribs is disposed along a diametrical extent of said head.

6. The method as set forth in claim 1, wherein:

said plurality of ribs are formed upon a top, outside surface of said head.

7. The method as set forth in claim 1, wherein:

said plurality of ribs are formed upon a bottom surface of said head.

8. The method as set forth in claim 3, wherein:

said punch is provided with three flow control channels so as to form three ribs upon said head.

9. The method as set forth in claim 1, wherein:

said head and said elongate member are integrally formed from a metal wire.

10. The method as set forth in claim 1, wherein:

said head and said elongate member are integrally formed together so as to comprise a nail fastener.

11. The method as set forth in claim 9, wherein:

said metal wire is fabricated from steel.

12. The method as set forth in claim 1, wherein:

said head is formed upon said elongate member so as to have a substantially circular configuration.

13. The method as set forth in claim 11, further comprising:

providing said steel wire with a coating of zinc so as to provide said steel wire with corrosion protection.

14. The method as set forth in claim 1, wherein:

said plurality of ribs are formed upon said head for increasing the strength of said head.

15. The method as set forth in claim 1, wherein:

said plurality of ribs are formed such that each rib has a height dimension which is within the range of 0.001–0.015 inches.

16. The method as set forth in claim 1, wherein:

said plurality of ribs are formed such that said ribs are spaced apart from each other by means of a distance of approximately 0.065 inches.

* * * * *

US005533379B1

REEXAMINATION CERTIFICATE (3579th)

United States Patent [19] [11] B1 5,533,379

Binder et al. [45] Certificate Issued Jul. 21, 1998

[54] METHOD OF FORMING A HEAD ON A FASTENER

[75] Inventors: John Binder, Morton Grove; Henry W. Schniedermeier, Niles; Lawrence S. Shelton, Morton Grove; Henry A. Sygnator, Arlington Heights; William L. Gabriel, Barrington, all of Ill.

[73] Assignee: Illinois Tool Works Inc., Glenview, Ill.

Reexamination Request:
No. 90/004,685, Jul. 3, 1997

Reexamination Certificate for:

| | |
|---|---|
| Patent No.: | **5,533,379** |
| Issued: | **Jul. 9, 1996** |
| Appl. No.: | **486,676** |
| Filed: | **Jun. 7, 1995** |

Related U.S. Application Data

[62] Division of Ser. No. 136,647, Oct. 14, 1993, Pat. No. 5,476,351.

[51] Int. Cl.[6] ..... B21G 3/12

[52] U.S. Cl. ..... 72/316; 470/27; 470/137; 72/377

[58] Field of Search ..... 72/316, 318, 377; 470/27, 34, 38, 40, 121, 137, 141, 159, 150, 195, 192, 196

[56] References Cited

FOREIGN PATENT DOCUMENTS

| | | |
|---|---|---|
| 77-29019 | 4/1979 | France . |
| 17-322 | 1/1942 | Japan . |
| 17-13010 | 11/1942 | Japan . |
| 93457 | 1/1951 | Japan . |
| 148284 | 3/1959 | Japan . |
| 148283 | 9/1959 | Japan . |
| 158933 | 12/1960 | Japan . |
| 212740 | 1/1963 | Japan . |
| 284217 | 9/1972 | Japan . |
| 56-50807 | 5/1981 | Japan . |

OTHER PUBLICATIONS

Monozukuri Kaitai Shinsyo, pp. 24 and 25.

*Primary Examiner*—Daniel C. Crane

[57] ABSTRACT

A method and apparatus for forming a head, having a controlled predetermined shape on an end of an elongate member, such as a wire, which is formed into a fastener, where an end portion of the wire is secured in a predetermined position and axially compressed so as to expand a predetermined amount of wire material radially outwardly and thereby form the head on the wire, and where material flow is directed during axial compression so as to provide the controlled predetermined shape of the head.

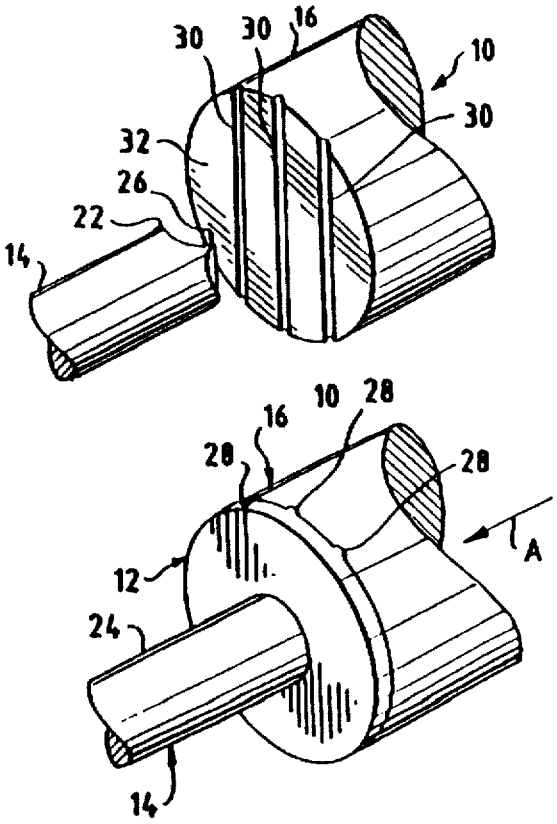

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 12 is cancelled.

Claim 1 is determined to be patentable as amended.

Claims 2–11 and 13–16, dependent on an amended claim, are determined to be patentable.

1. A method of forming a head on an elongate member *so as to form a headed fastener*, comprising the steps of:

positioning an end portion of an elongate member, *having a longitudinal axis,* at a predetermined location; and exerting an axially compressive force against said end portion of said elongate member so as to [radially outwardly] expand a [predetermined] *first* amount of material of said end portion of said elongate member *radially outwardly* and thereby form a head [thereon which includes] *upon said end portion of said elongate member, and to cause a second amount of material of said end portion of said elongate member to flow in opposite directions away from a central portion of said formed head so as to form* a plurality of ribs, [all] disposed parallel with respect to each other and *extending across said head so as to also be disposed parallel* with respect to a single diameter of said head [and extending across said head], for controlling the flow of said *first amount of* material, comprising said end portion of said elongate member *and used to form said head upon said end portion of said elongate member,* [in a predetermined direction parallel to said single diameter, and for] *by* accommodating said *second amount of* material comprising said end portion of said elongate member as said *first amount of* material comprising said end portion of said elongate member is expanded radially outwardly with respect to said elongate member of said fastener during said axial compression of said end portion of said elongate member and said formation of said head upon said elongate member such that said head has a [predetermined] *substantially circular* configuration and wherein said head is substantially centered with respect to *said* longitudinal axis of said elongate member.

* * * * *